US011197532B2

(12) United States Patent
Horowitz

(10) Patent No.: US 11,197,532 B2
(45) Date of Patent: Dec. 14, 2021

(54) INTEGRATED TOWEL AND CARRIER ASSEMBLY

(71) Applicant: Jordan Horowitz, Jersey City, NJ (US)

(72) Inventor: Jordan Horowitz, Jersey City, NJ (US)

( * ) Notice: Subject to any disclaimer, the term of this patent is extended or adjusted under 35 U.S.C. 154(b) by 0 days.

(21) Appl. No.: 16/892,930

(22) Filed: Jun. 4, 2020

(65) Prior Publication Data

US 2020/0390223 A1 Dec. 17, 2020

Related U.S. Application Data

(60) Provisional application No. 62/860,116, filed on Jun. 11, 2019.

(51) Int. Cl.

| | |
|---|---|
| ***A45F 4/02*** | (2006.01) |
| ***A45F 3/02*** | (2006.01) |
| ***A45C 13/10*** | (2006.01) |
| ***A45C 13/02*** | (2006.01) |
| *A45F 3/00* | (2006.01) |

(52) U.S. Cl.

CPC ..... *A45F 4/02* (2013.01); *A45C 13/02* (2013.01); *A45C 13/103* (2013.01); *A45F 3/02* (2013.01); *A45F 2003/003* (2013.01)

(58) Field of Classification Search

CPC ..... A45F 4/02; A45F 3/02; A45F 2003/003; A45C 13/02; A45C 13/103

USPC ..... 224/575

See application file for complete search history.

(56) References Cited

U.S. PATENT DOCUMENTS

| | | | | |
|---|---|---|---|---|
| 5,785,219 | A * | 7/1998 | Kraft | A45F 4/02 2/66 |
| 6,223,367 | B1 * | 5/2001 | French | A45C 3/10 383/4 |
| 6,276,828 | B1 * | 8/2001 | Otley | A45C 9/00 224/576 |
| 7,017,206 | B1 * | 3/2006 | Kedineoglu | A45F 4/02 5/417 |
| 10,736,405 | B2 * | 8/2020 | Larsen | A45F 3/04 |
| 2002/0074251 | A1 * | 6/2002 | Hirshberg | A45C 9/00 206/315.1 |
| 2004/0123386 | A1 * | 7/2004 | Higashi | A45F 4/02 5/420 |
| 2004/0155077 | A1 * | 8/2004 | Cullen | A45F 4/08 224/153 |
| 2005/0071920 | A1 * | 4/2005 | Higashi | H01R 13/523 5/417 |
| 2007/0113338 | A1 * | 5/2007 | Remblad | A45F 4/06 5/420 |

(Continued)

*Primary Examiner* — Peter N Helvey

(74) *Attorney, Agent, or Firm* — Howard M. Gitten; Lewis Brisbois Bisgaard & Smith LLP

(57) ABSTRACT

An integrated towel and carrier assembly forms a reversible bag capable of exhibiting a first state and a second state, the second state being the reversal of the first state. The bag is formed from a first panel having a first face and a second opposed face. A first sealable opening is formed within the first panel providing access to a bag interior. A towel is affixed to a first panel face and extends from that face. The first sealable closing is dimensioned to allow at least a portion of the towel to extend therethrough when the towel is fully opened. A second panel is affixed to, and spaced from, the first panel to form a compartment therebetween. A second sealable opening is formed on the compartment.

9 Claims, 9 Drawing Sheets

(56) References Cited

U.S. PATENT DOCUMENTS

| | | | | |
|---|---|---|---|---|
| 2016/0166093 | A1* | 6/2016 | Wong-Shaw | A47G 9/062 383/4 |
| 2016/0375650 | A1* | 12/2016 | Goecke | B32B 9/025 383/4 |

* cited by examiner

INTEGRATED TOWEL AND CARRIER ASSEMBLY

CROSS REFERENCE TO RELATED APPLICATIONS

This application claims priority to U.S. Provisional Patent Application No. 62/860,116, filed Jun. 11, 2019; the entire contents of the aforementioned application is hereby incorporated herein by reference.

BACKGROUND OF THE INVENTION

The present invention is directed to a structure for storing and a carrying a towel, and more particularly an integrated towel and carrier assembly which enables storage and use of the towel while providing an integrated carrying structure for other items.

Since almost the beginning of time beachgoers have been bringing a towel and other items to the beach; usually toting them in some type of bag. However, what sometimes happens in the race out the door and stuffing the bag with items such as food, sunscreen, telephones and the like the bather forgets to pack their towel; or believes that the towel is buried under the other items. Furthermore, once the bather gets to the beach and utilizes the towel, the bag, made from a lightweight material can often blow away, become full of sand, or even expose the items therein to water; damaging the items therein.

Additionally, when packing up to leave the beach, the towel itself may be wet or sandy. It is not desirable at the end of the day to combine the wet and sandy towel with the other items within the bag; often forcing the bather to carry the towel separately from the bag. This defeats, in part, the reason for having the beach bag to carry beach items to the beach or car in the first place.

Accordingly, a structure which overcomes the shortcomings of the prior art by preventing the bag from being separated from the towel, while anchoring the bag and protecting both the items within the bag and the towel from the elements is desired.

SUMMARY OF THE INVENTION

An integrated towel and carrier assembly includes a reversible bag capable of exhibiting a first state and a second state, the second state being the inside out condition of the first state. The bag is formed from a first panel having a first face and a second opposed face. A first selectively sealable opening is formed within the first panel providing access to an interior of the bag. A closing means is disposed on the bag for selectively sealing the sealable closing. A towel is affixed to one of the first face and second face and extends from that face. The first sealable closing is dimensioned to allow at least a portion of the towel to extend therethrough when the towel is fully opened. A second panel is affixed to, and spaced from, the first panel to form a first compartment therebetween. A second sealable opening is formed on the first compartment. A second closing means is disposed on the first panel for selectively sealing the second sealable opening to seal the first compartment formed by the second panel and the first panel.

BRIEF DESCRIPTION OF THE DRAWINGS

The present disclosure will be better understood by reading the written description with reference to the accompanying drawing Figures in which like reference numerals denote similar structure and refer to like elements throughout in which:

FIG. 1 is a top front perspective view of an integrated towel and carrier assembly constructed in accordance with the invention;

DETAILED DESCRIPTION OF THE PREFERRED EMBODIMENTS

Figure 7:
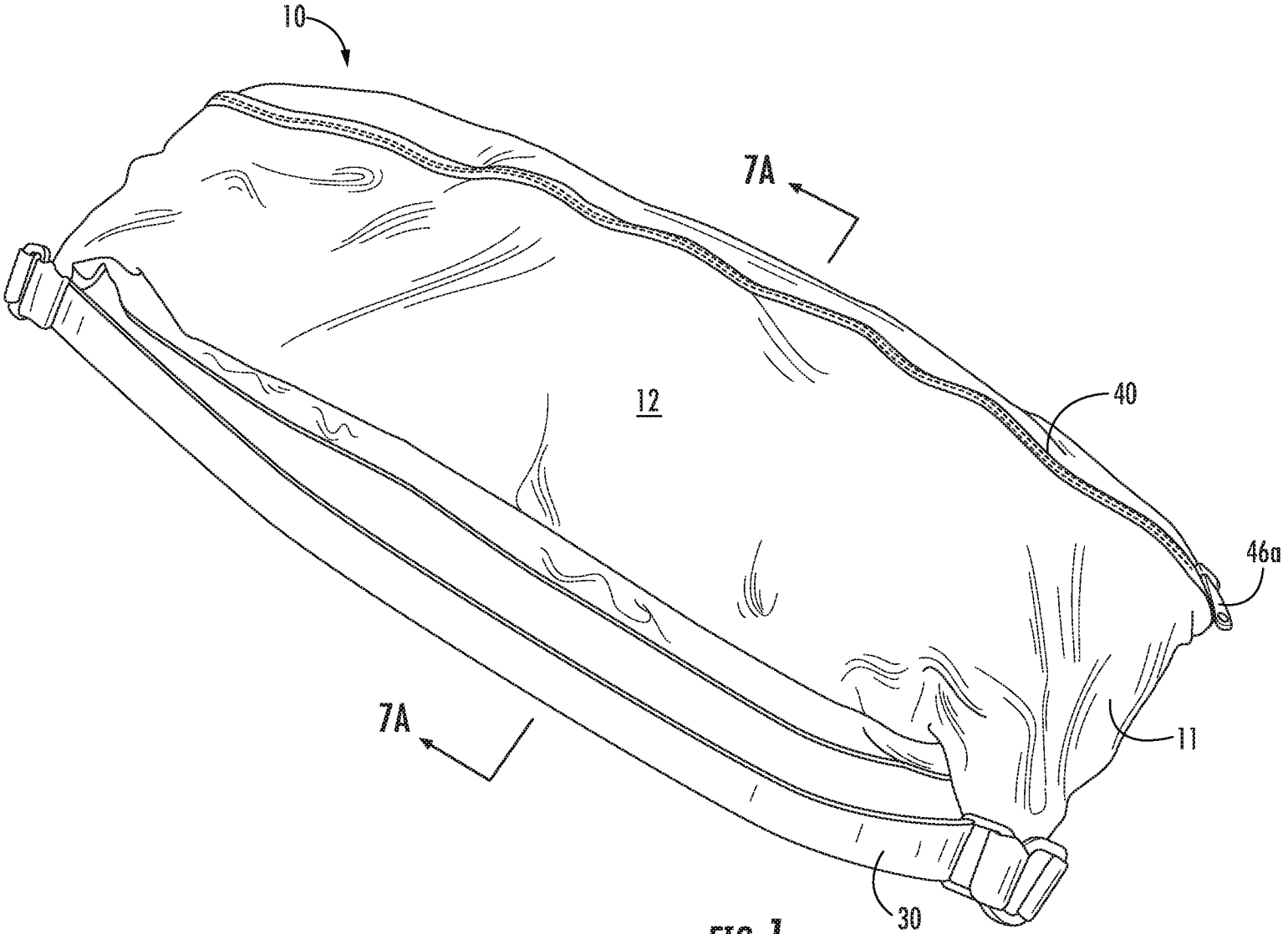
FIG. 7A is a sectional view taken along line 7A-7A of FIG. 1.
FIGS. 7B-7D are sectional views taken along line 7A-7A of the integrated towel and carrier assembly showing sequential steps in extending the towel from the bag of the integrated towel and carrier assembly in one mode of operation in accordance with the invention.
Figure 2:
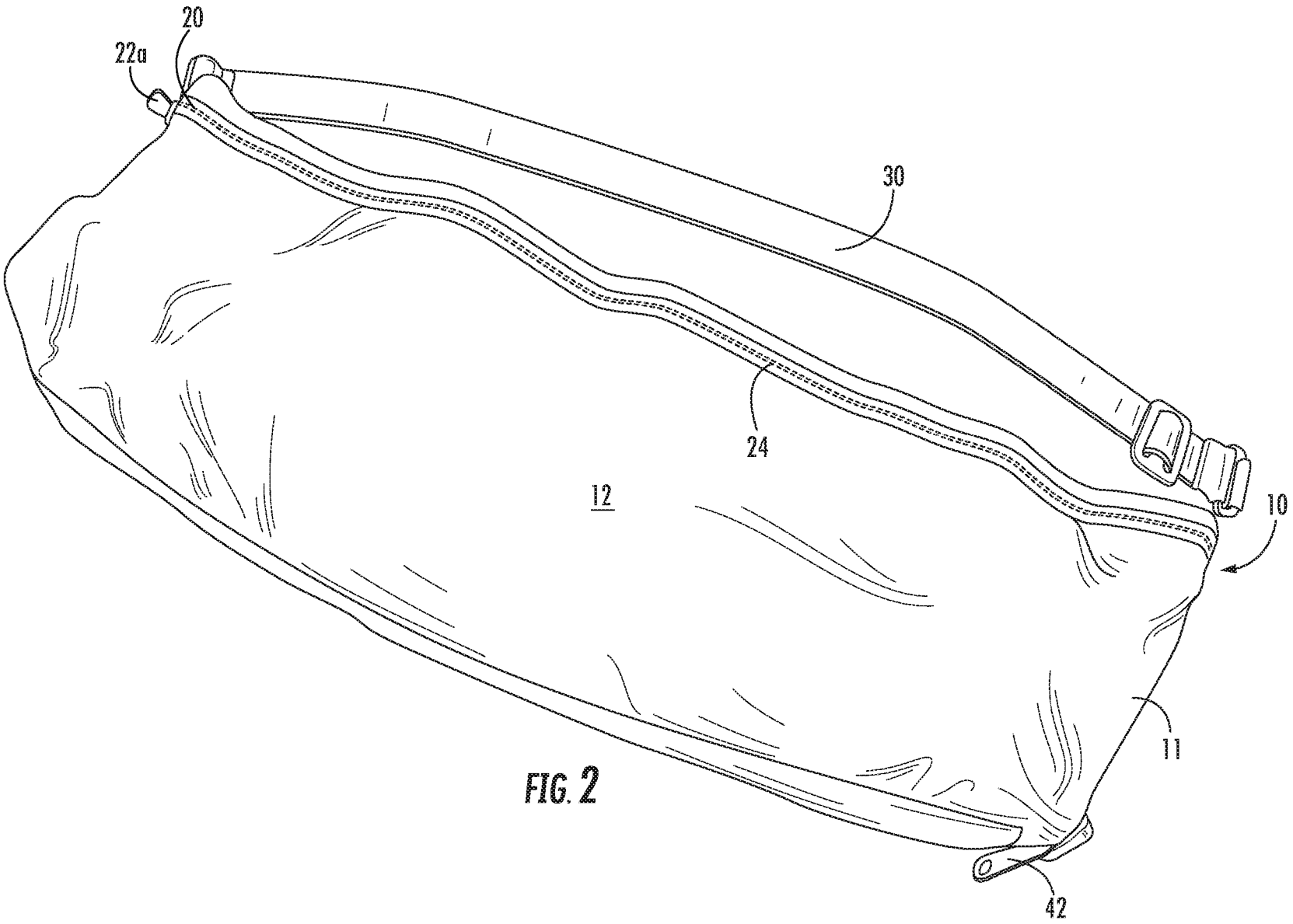
FIG. 2 is a bottom rear perspective view of an integrated towel and carrier assembly constructed in accordance with the invention.
Figure 7A:
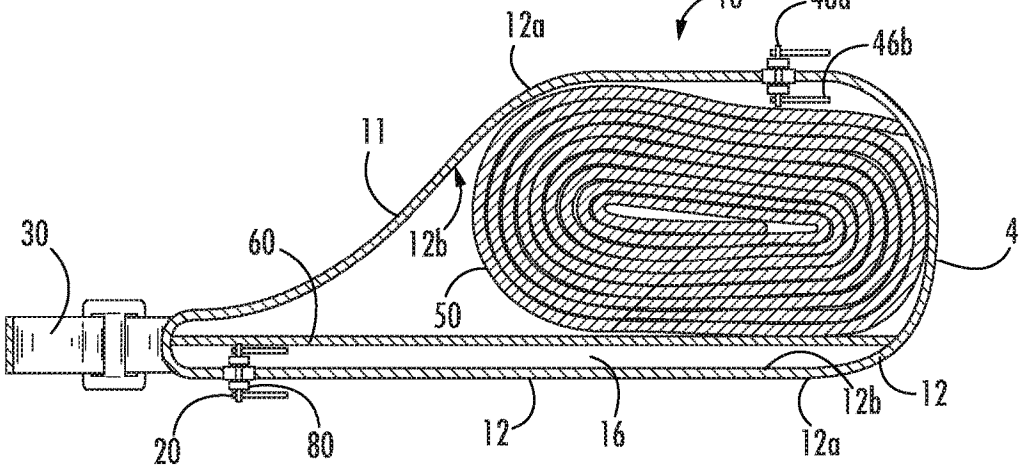

Reference is first made to FIGS. 1, 2 and 7A in which an integrated towel and carrier assembly 10, constructed in accordance with the invention, is provided. Assembly 10 includes a reversible bag 11 capable of exhibiting a first state and a second state, the second state is the inside out condition of the first state. The bag 11 is formed from a first panel of material 12 which is sealed upon itself to form the bag 11 structure; panel 12 having a first face 12*a* and a second opposed face 12*b*. An adjustable shoulder strap 30 is affixed to surface 12*a* of panel 12. A towel 50 is affixed to first face 12*b*. In a preferred non limiting embodiment panel 12 is formed of a malleable (can easily change its shape) water resistant or water proof material. Towel 50 is preferably made of a water absorbent material; however the scope of invention includes structure, if the intent is more of a blanket for sitting, to be made of any material capable of being folded as described below.

A panel 60 extends from a first position on face 12*b* of panel 12 to a second position on face 12*b* of panel 12. A portion 14 of panel 12 extends from substantially adjacent the first position at which panel 60 extends from face 12*b*. Adjustable strap 30 is affixed to panel 12 substantially adjacent the second position at which panel 60 is affixed to panel 12. Panel 60 is spaced from face 12*b* of panel 12 forming a compartment 16 therebetween.

A first selectively resealable opening 70 is formed as a slit in panel 12 of the bag 11 and provides access to the interior of the bag 11 in both the first state and the second state. (See FIG. 5A). Opening 70 is sealed in a preferred, nonlimiting embodiment by a zipper 40, extending along substantially the length of the bag 11, having teeth 42 and a slider 46 having tabs 46A, 46B making zipper 40 usable in either state of the bag 11. As known in the art, zipper 40 may be replaced with other sealing structure such as Velcro® hook fasteners, buttons, snaps or the like. For reasons that will become self-evident below, the width of opening 70 should be sufficient to allow towel 50 and panel section 14 to pass easily therethrough; with not much interference from panel 12.

A second selectively resealable opening 80 is formed at a slit in panel 12 at a position in facing relationship with panel 60 and provides access to the interior of compartment 16. (See FIG. 7D). Opening 80 is sealed in a preferred, non-limiting embodiment by a zipper 20 extending along the length of opening 80, having teeth 24 and a slider 22 having tabs 22*a*, 22*b*. Again, as known in the art zipper 20 may be replaced with other sealing structure such as Velcro® hook fasteners, buttons, snaps or the like.

As seen when comparing FIG. 1 with FIG. 2 resealable opening 70 is spaced from resealable opening 80. This is to separate the functionality of compartment 16 from towel 50 while at the same time providing the benefits of easy access to compartment 16 when the assembly 10 is being carried and protection of compartment 16 when towel 50 is extended. As a result, opening 70 and resealable zipper 40 are on panel 12 on a portion of the bag 11 formed thereby opposite from a position on panel 12 on the bag 11 where zipper 20 is disposed. Furthermore, zipper 20 is disposed closer to adjustable strap 30 then zipper 40.

Figure 3:
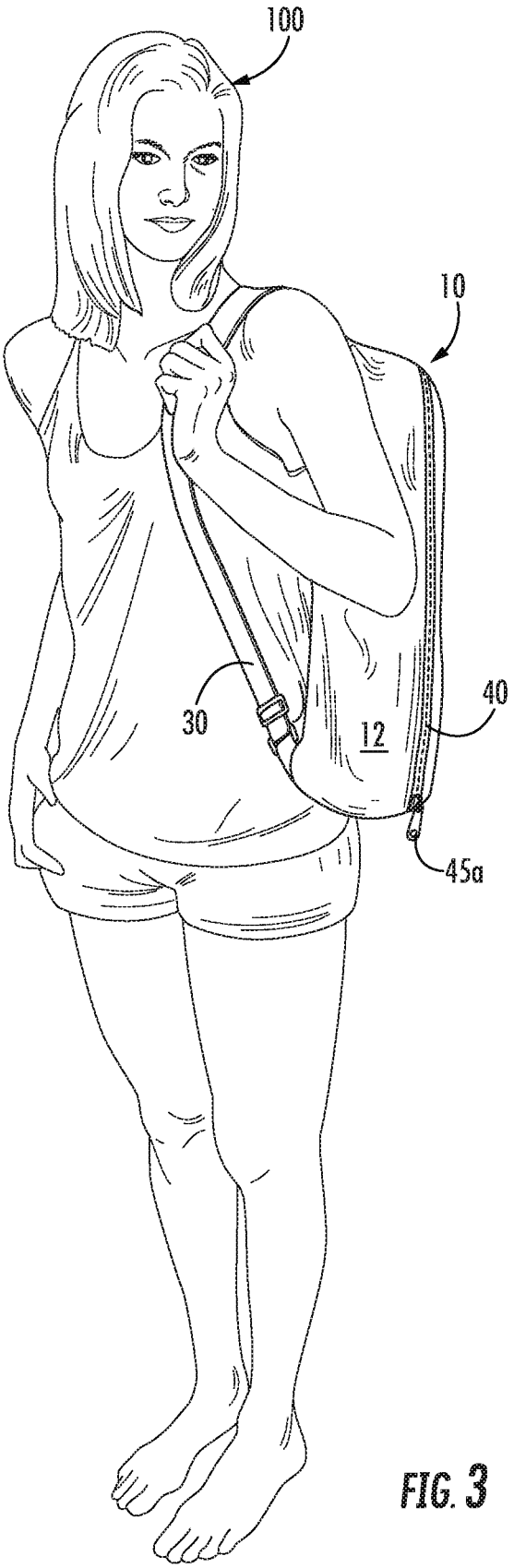
FIG. 3 is a view of the integrated towel and carrier assembly in the carrying mode in use.

Use of towel carrier assembly 10 will now be described with reference first to FIGS. 1-3. A first state of assembly 10 is shown in these figures in which assembly 10 is in the carrying mode; towel 50 is within the bag 11 formed by panel 12 and sealed away to be carried utilizing adjustable strap 30. In this first state, zipper 40 is closed preventing access to towel 50 and preventing towel 50 from inadvertently falling from the bag 11. At the same time zipper 20 is exposed for use by a user and is also closed to prevent unintended access to anything within compartment 16. Items such as glasses, car keys, house keys, a wallet or the like may be contained in compartment 16. Also because zipper 20 is on an opposed side of the bag 11 from zipper 40, zipper 20 may be held against the body of the user providing further protection against unwanted access to compartment 16.

Reference is now made to FIGS. 5A-7D in which operation of the towel and carrier assembly 10 to make use of towel 50 is shown. When a user arrives at a site towel 50 is contained within the bag 11 facing face 12*b* of panel 12 forming bag 11. To access towel 50, zipper 40 is used to open opening 70 formed within panel 12. As seen in FIG. 7B opening 70 provides access to towel 50.

Towel and carrier assembly 10 is then transformed into a second state; a state in which panel 12 is inverted, so that the bag 11 is turned inside out and towel 50 is exposed for use. In a first step the opposed portions of panel 12 across opening 70 are moved in the opposite directions shown as Arrow A and Arrow B respectively; providing access to towel 50.

Figure 7B:
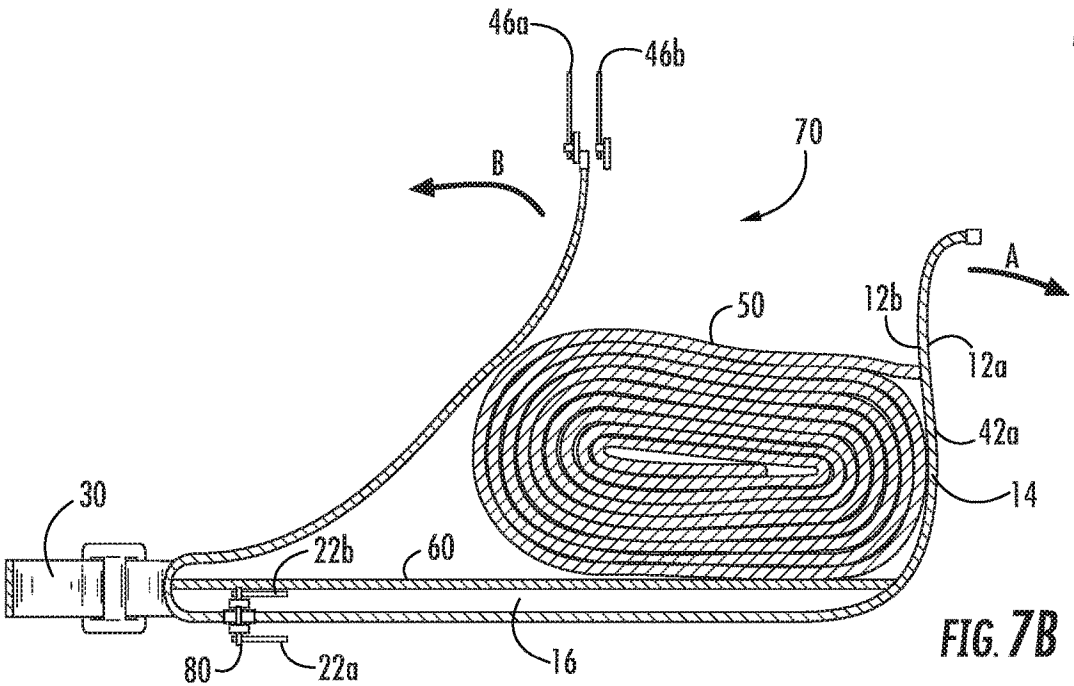
Figure 7C:
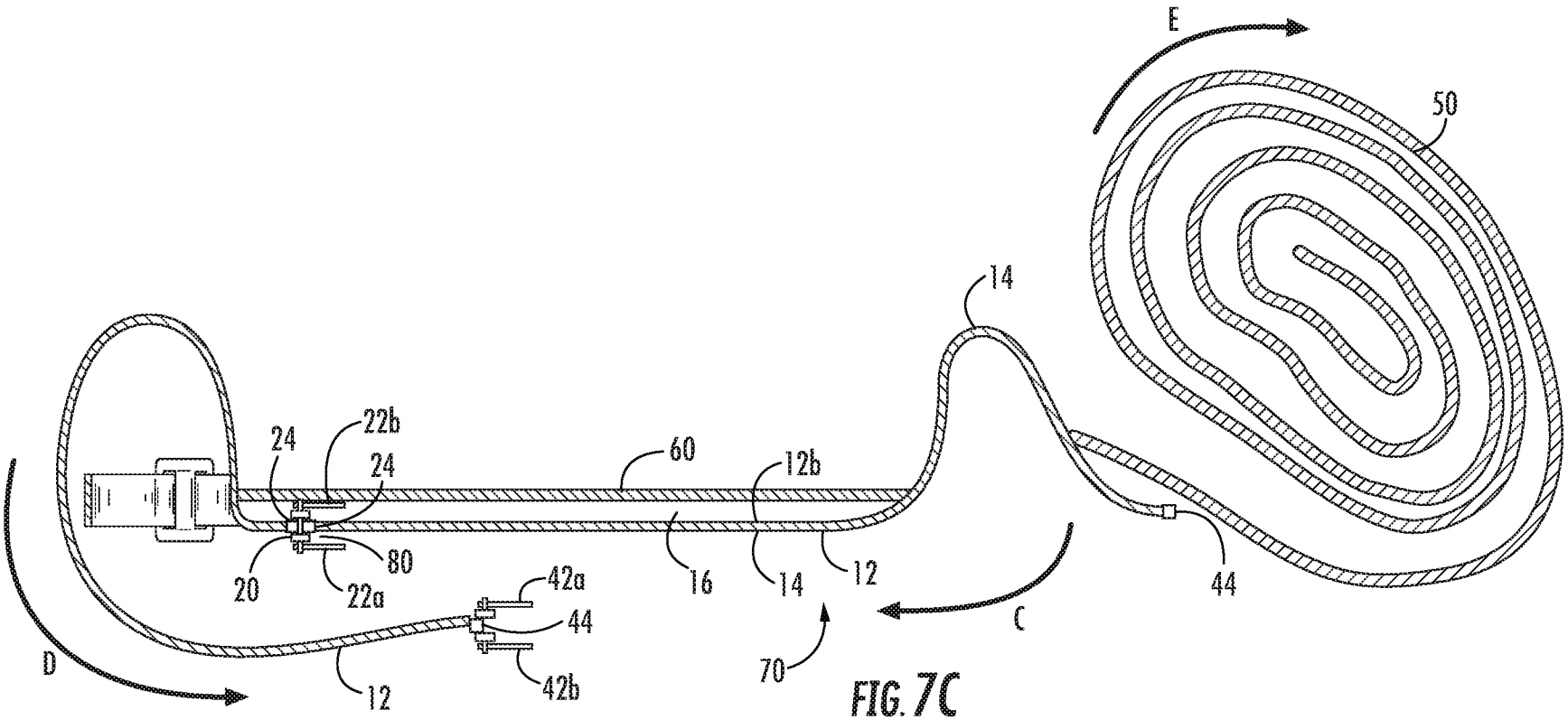

As seen in FIG. 7C the opposed sides of opening 70 are continued to be rotated in the directions of Arrow C and Arrow D respectively which not only exposes panel 60 but enables towel 50 to move through opening 7, and to be opened by unrolling towel in the direction of Arrow E. In this transitional stage panel 60 becomes an outer surface of the bag 11 and panel face 12*b* becomes the remaining part of the outer surface of the bag 11; "inside out" or inverted state. Towel 50 is attached to panel 12 at panel portion 14 between teeth 44 of zipper 40 and panel 60. Panel portion 14 acts as an extension to position towel 50 away from bag 11 when towel and carrier assembly 10 is in the second or inverted state.

Figure 4:
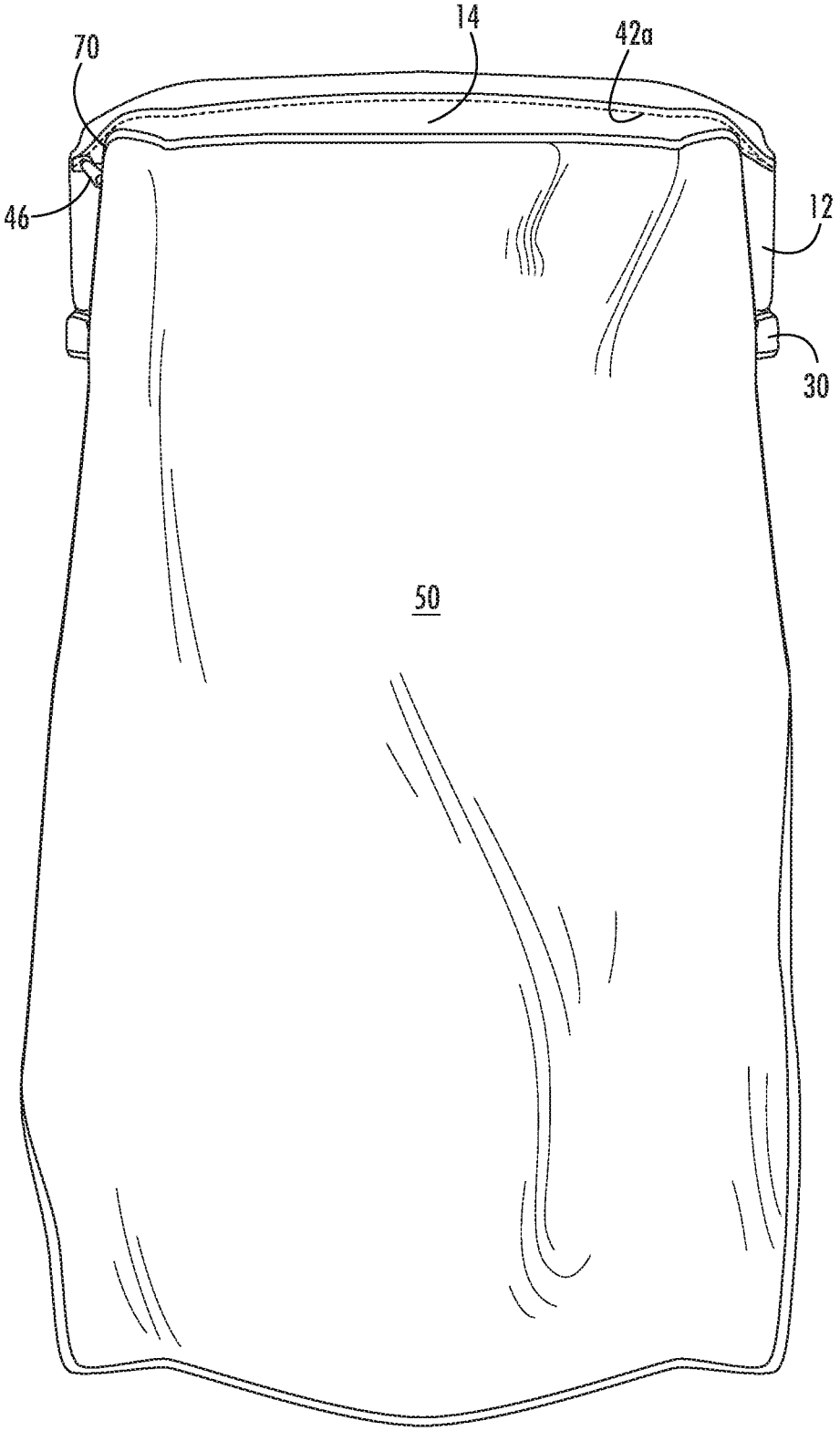
FIG. 4 is a top perspective view of the integrated towel and carrier assembly during operation thereof.

As seen in FIG. 4 towel 50 extending from panel portion 14 extends through opening 70 as if extending from the bag 11 formed by panel 12. While opening 70 enables use of towel 50, it also allows debris and dirt to get into the bag 11 through opening 70. As seen from FIG. 4 opening 70 is a slit in panel 12 along the bag 11 sized to enable towel 50 to pass therethrough in an open, unfolded width wise and length-wise, state. Additionally, in the state shown in FIG. 4 strap 30 is exposed to get in the way of things. Therefore it is desired to place bag 11 in a position away from towel 50 and in a closed state. This is done by inverting the bag 11 so that face 12*b* of panel 12 is exposed to the outside.

Figure 5A:
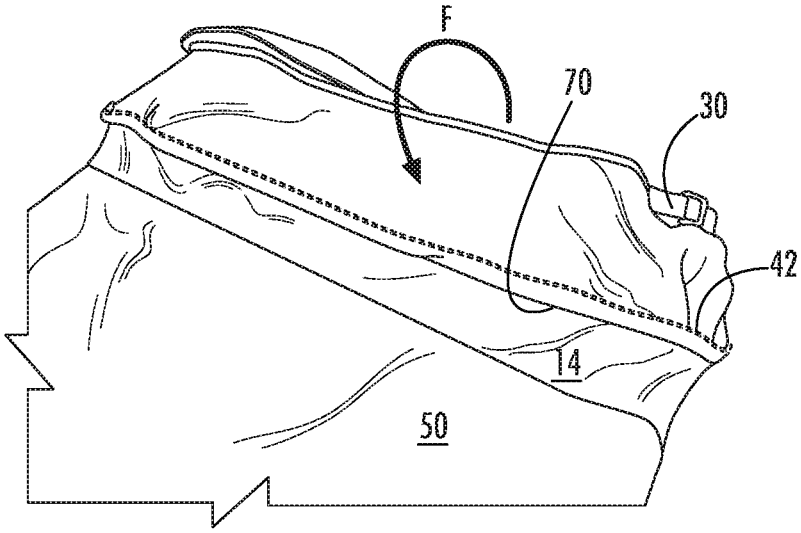
FIGS. 5A-5C are partial views of sequential steps in extending the towel from the integrated towel and carrier assembly in one mode of operation in accordance with the invention.
Figure 5B:
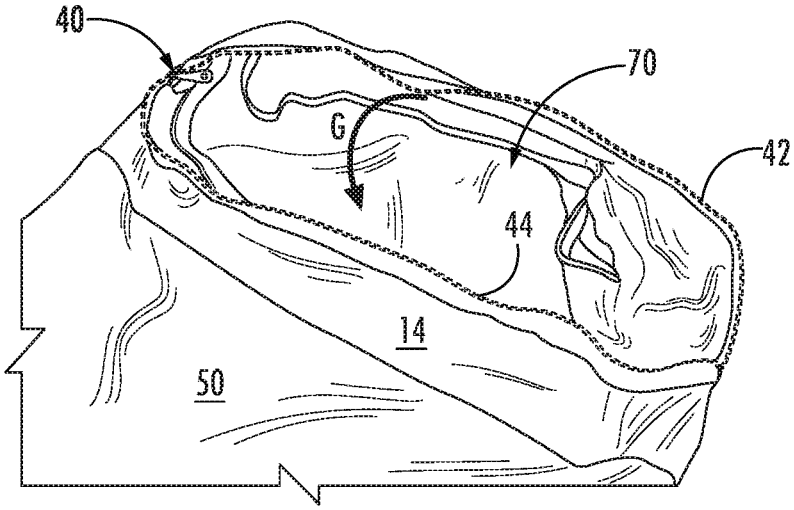
Figure 5C:
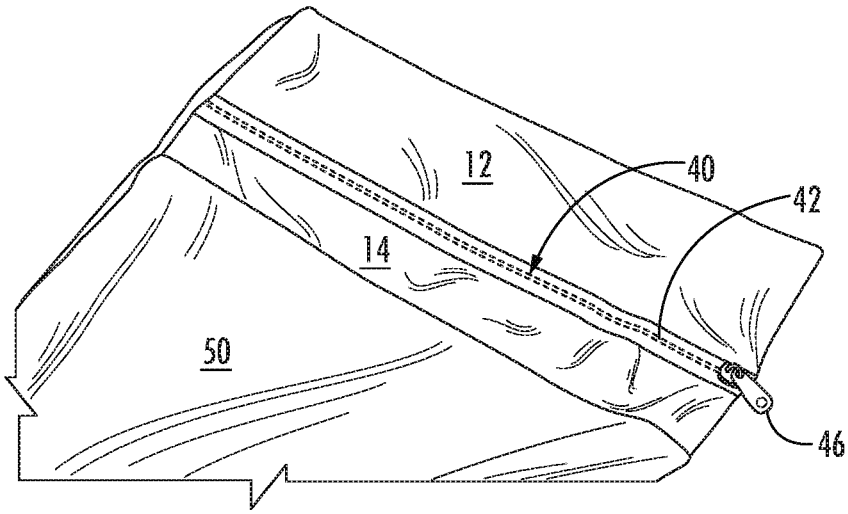

As seen in FIG. 5A once towel 50 and panel portion 14 are extended from panel 12, one edge of opening 70 is rotated in the direction of arrow F to be in contact with the opposed edge of opening 70. This places the attachment of panel portion 14 away from opening 40 so that the bag 11 can be inverted and placed inside itself as shown in FIG. 5B by continued movement of teeth 42 in the direction of Arrow G to be brought together and closed forming zipper 40. In this way, the towel and carrier assembly 10 is in the second state in which towel 50 is exposed for use away from the bag 11 formed by panel 12 and it is face 12*b* and panel 60 which is now the exterior face of bag 11.

Figure 6A:
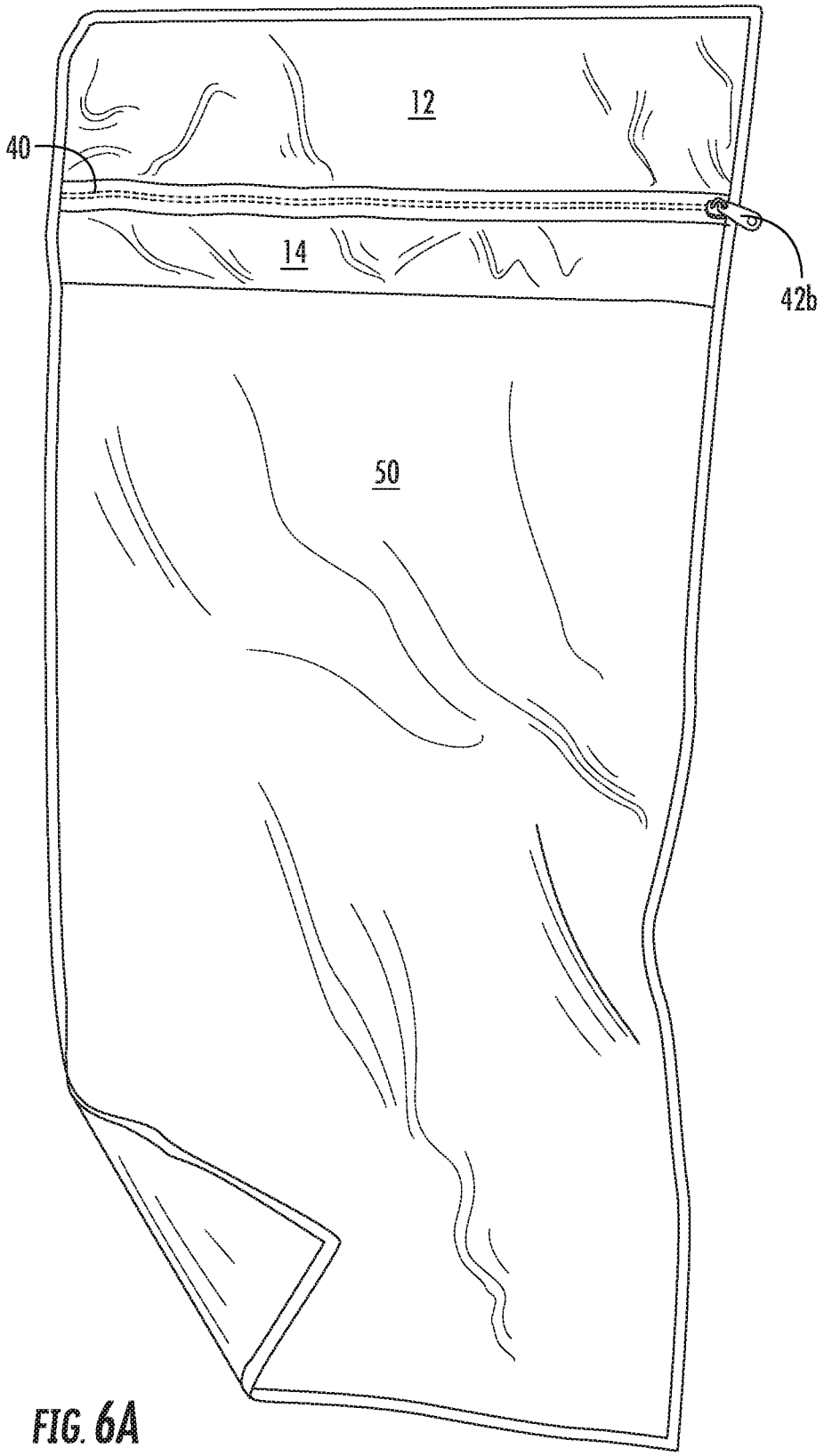
FIG. 6A is a top plan view of the integrated towel and carrier assembly in a towel extended condition.
Figure 6B:
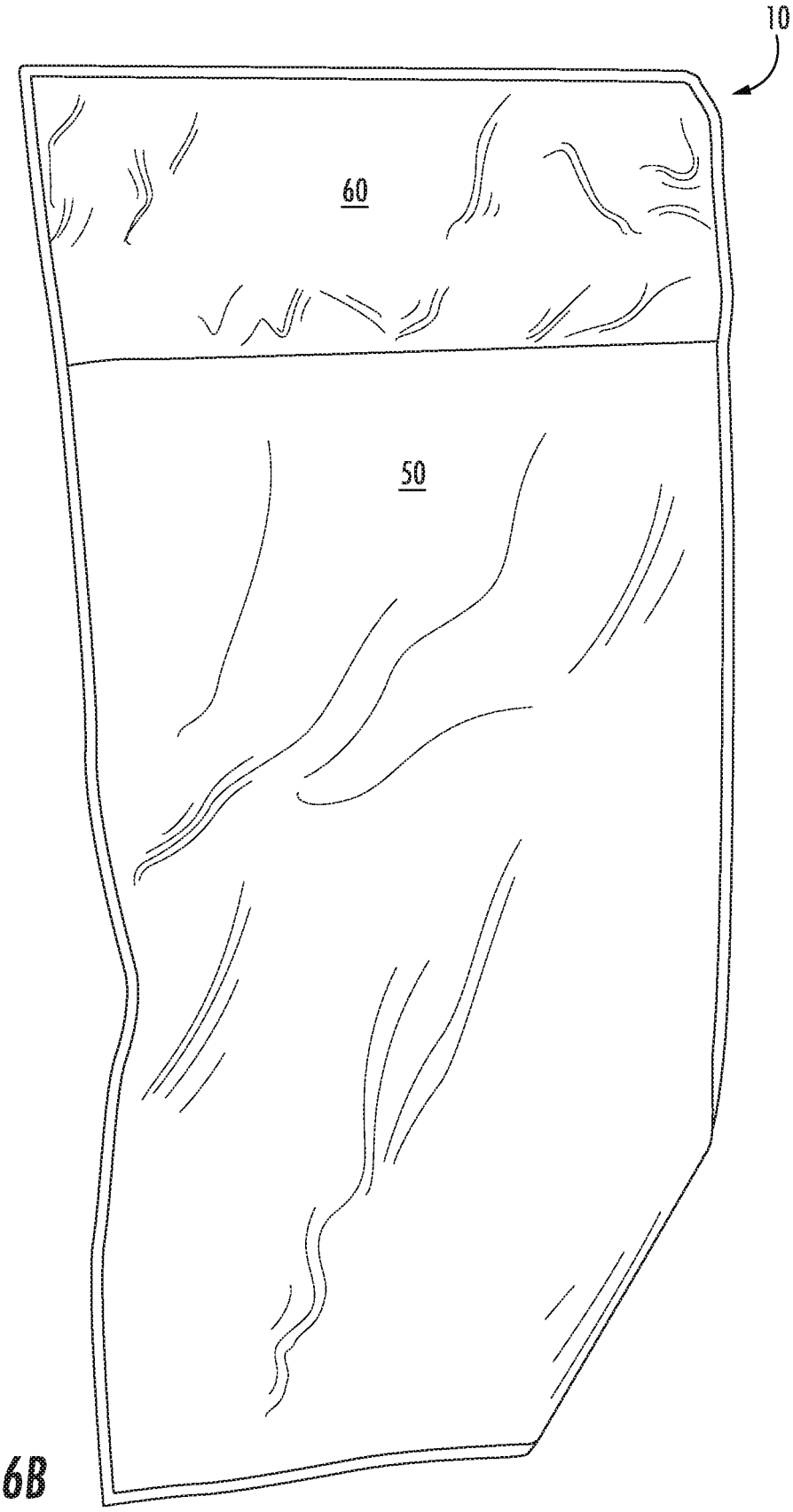
FIG. 6B is a rear plan view of the integrated towel and carrier assembly in a towel extended condition.
Figure 7D:
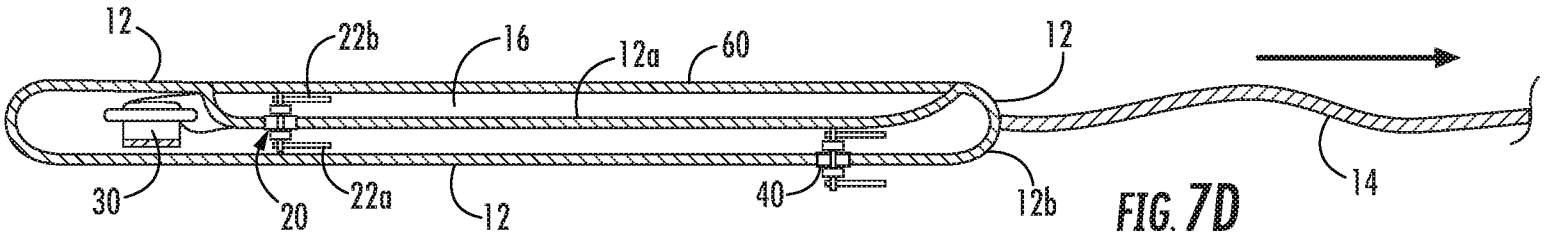

As seen in FIGS. 6A and 6B once in the second state, towel 50 is extended and the bag 11 is disposed in a closed manner away from towel 50 so as to maintain the integrity of the interior of the bag 11 without interfering with enjoyment of towel 50. Panel 60 now forms a portion of the exterior of the bag 11. As seen in FIG. 7D by inverting bag 11 zipper 20 and opening 80 are within the bag 11 so that access to compartment 16 can only be accessed utilizing zipper 40 and zipper 20 providing added security and protection against the elements for valuables that may be placed in the bag 11.

As a result of this above structure, one going to the beach will not forget their bag, and therefore will not forget their towel. Secondly, by affixing the towel to an extension of the panel facing the bag, the user sitting on the towel anchors the bag to the ground without the bag interfering with enjoyment f the towel. The integral compartment structure with a separate access prevents the towel and items in the compartment form interfering with each other; sunscreen on the towel, or water and sand form the towel affecting things within the compartment. The towel no longer needs to be carried separately from the bag after use.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

The invention claimed is:

1. An integrated towel and carrier assembly comprising;

a reversible bag capable of exhibiting a first state and a second state, the second state being an inside out condition of the first state; the bag comprising, a first panel having a first face and a second opposed face forming the bag;

a first selectively sealable opening formed within the first panel providing access to an interior of the bag;

a towel directly affixed to one of the first face and second face, at a position away from the sealable opening, and extends from that face, the first sealable opening being dimensioned to allow at least a portion of the towel to extend therethrough when the towel is fully opened;

a second panel affixed to, and spaced from, the first panel to form a compartment therebetween; wherein the second panel has a first end and a second end, the second panel being in facing relation with the first panel and affixed to the first panel at the first end of the second panel and the second end of the second panel; and a second selectively sealable opening formed on the first panel, providing access to the compartment.

2. The integrated towel and carrier assembly of claim 1 further comprising a first closing means for selectively closing the first sealable opening.

3. The integrated towel and carrier assembly of claim 1, wherein the second selectively sealable opening is formed within the first panel.

4. The integrated towel and carrier assembly of claim 2, wherein the first closing means is a zipper.

5. The integrated towel and carrier assembly of claim 1, wherein a portion of the first panel extends beyond a position on the first panel where the second panel is affixed to the first panel to form the compartment, and the towel is affixed to the first panel at the portion extending beyond the position on the first panel.

6. The integrated towel and carrier assembly of claim 1, further comprising a strap affixed to a face of the first panel opposed to the face of the first panel to which the towel is attached, at a position along the first panel between the first selectively sealable opening and the second selectively sealable opening.

7. The integrated towel and carrier assembly of claim 2, further comprising a second closing means for selectively closing the second sealable opening.

8. The integrated towel and carrier assembly of claim 7, wherein the second closing means is a zipper.

9. The integrated towel carrier assembly of claim 1, wherein the first selectively sealable opening is disposed on the bag at a position substantially opposed to the second selectively sealable opening when the bag is an a reversed state; the reversed state including the towel at least partially extending from one of the first face and second face; and the first sealable opening being in a closed condition.

* * * * *